US005577611A

United States Patent [19]

Greenall

[11] Patent Number: 5,577,611

[45] Date of Patent: Nov. 26, 1996

[54] ORGANIZER FOR PERSONAL EFFECTS

[76] Inventor: William C. Greenall, The Bungalow, 9A Penbury Road, Whitley, Wigan Lancashire WN1 2RJ, United Kingdom

[21] Appl. No.: 448,431

[22] PCT Filed: Oct. 10, 1994

[86] PCT No.: PCT/GB94/02210

§ 371 Date: Jul. 7, 1995

§ 102(e) Date: Jul. 7, 1995

[87] PCT Pub. No.: WO95/10203

PCT Pub. Date: Apr. 20, 1995

[30] Foreign Application Priority Data

Oct. 9, 1993 [GB] United Kingdom ..... 9320833

[51] Int. Cl.[6] ..... A45C 13/18

[52] U.S. Cl. ..... 206/459.1; 190/18 R; 190/101

[58] Field of Search ..... 206/315.1, 315.11, 206/581, 38, 37, 459.1, 278; 383/5; 190/18 R, 101; 150/102; 220/475

[56] References Cited

U.S. PATENT DOCUMENTS

| | | | |
|---|---|---|---|
| 2,265,727 | 12/1941 | Greenstadt . | |
| 2,990,924 | 7/1961 | Plunkett . | |
| 3,079,965 | 3/1963 | Troy . | |
| 4,356,854 | 11/1982 | McGee . | |
| 4,502,576 | 3/1985 | Reardon . | |
| 4,632,241 | 12/1986 | Brough et al. . | |
| 4,792,026 | 12/1988 | Dimmick et al. | 190/101 |
| 5,153,561 | 10/1992 | Johnson | 190/101 X |
| 5,161,561 | 11/1992 | Jamieson . | |

FOREIGN PATENT DOCUMENTS

| | | |
|---|---|---|
| 342300 | 11/1989 | European Pat. Off. . |
| 893665 | 8/1944 | France . |
| 8801098 | 4/1988 | Germany . |
| 380818 | 3/1932 | United Kingdom . |
| 1048186 | 11/1966 | United Kingdom . |
| 2218684 | 11/1989 | United Kingdom . |

*Primary Examiner*—Jacob K. Ackun
*Attorney, Agent, or Firm*—Oliff & Berridge

[57] ABSTRACT

An organiser bag (20) is supported on a ground engaging stand (10) and is provided with a hanging rail or rails.

12 Claims, 4 Drawing Sheets

ORGANIZER FOR PERSONAL EFFECTS

This invention concerns an organiser for personal effects, particularly though not exclusively, for use on a beach. When a bag containing clothing and personal effects is taken onto a beach considerable inconvenience is often experienced if the bag is placed on the sand since apart from the difficulty of locating individual and perhaps small items at the bottom of the bag there is a risk that sand and skin protection creams and oils may contaminate the contents. In addition, even when a parasol is present there is often nowhere to suspend towels and clothing.

An object of the present invention is to provide an organiser for personal effects which provides not only a readily accessible container which is suspended above the ground, but also a means upon which clothing and towels may be suspended.

According to the present invention there is provided an organiser for personal effects, comprising a bag having at least one compartment, at least one opening for access thereto, and means on the bag engageable with a ground engaging member such that the entire bag may be supported thereon at an elevated position above the ground, characterised by at least one hanging rail attached to the bag whereby a towel or the like may be suspended at said elevated position above the ground.

Preferably, means are included whereby the bag may be rotated through 360° about an upright axis defined by the ground engaging member.

An embodiment of the invention will now be described by way of example only, with reference to the accompanying schematic drawings, in which;

FIGS. 1*a*, 1*b* and 1*c* are various views of a ground engaging member forming part of an organiser made in accordance with the invention;

Figure 1A:
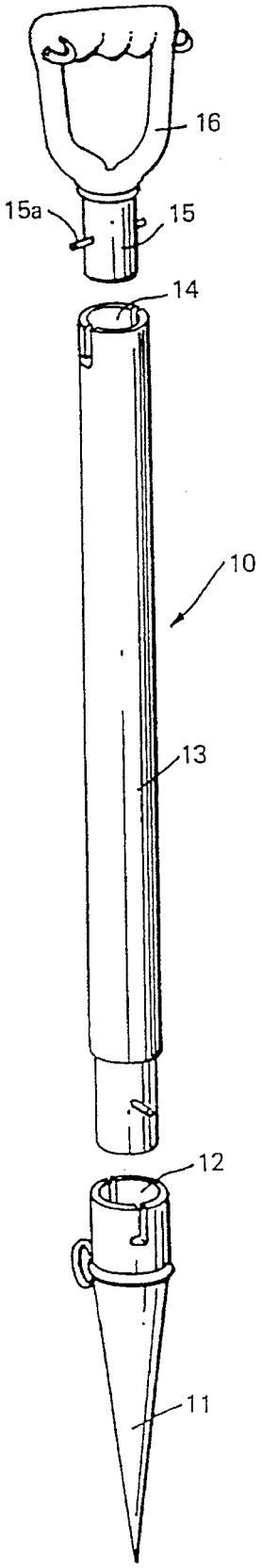
Figure 1B:
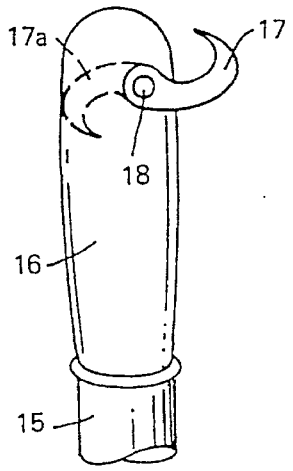
Figure 1C:
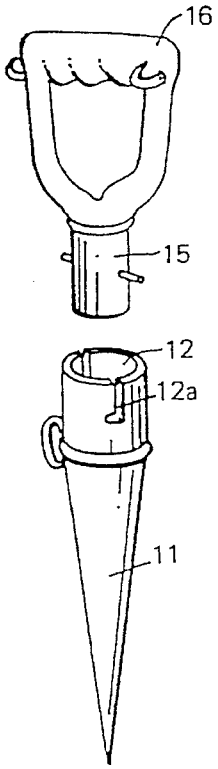

Referring now to the drawings, FIGS. 1*a* to 1*c* illustrate a ground engaging stand generally indicated at (10) and comprising a spike (11) which may be partially hollow and made from a plastics material or an alloy and presenting at its upper end a socket (12) into which a spigot at the lower end of a stem (13) may be removably located. The stem (13) may also be hollow and made from a material similar to that of the spike (11) thus presenting a socket (14) at its upper end into which a spindle (15) is removably located with a handle (16) rigidly attached thereto. Preferably, the spindle is equipped with diametrically opposed pins (15*a*) which locate as a "bayonet" fitting into the socket (14) having angled slots (14*a*) for the purpose.

At each of two opposed sides of the handle (16) there is provided a supporting hook (17) pivotally mounted at (18) thus to be movable between a stowed position illustrated at 17*a* in FIG. 1*c* and an active position illustrated in full lines. As shown in FIG. 1*c*, the spindle (15) may be inserted directly into the socket (12) in spike (11) to assist in driving of the spike into the ground. The socket (12) is also equipped with angled slots (12*a*), to enable the spike (11) to be removed from the ground when required.

Figure 2:
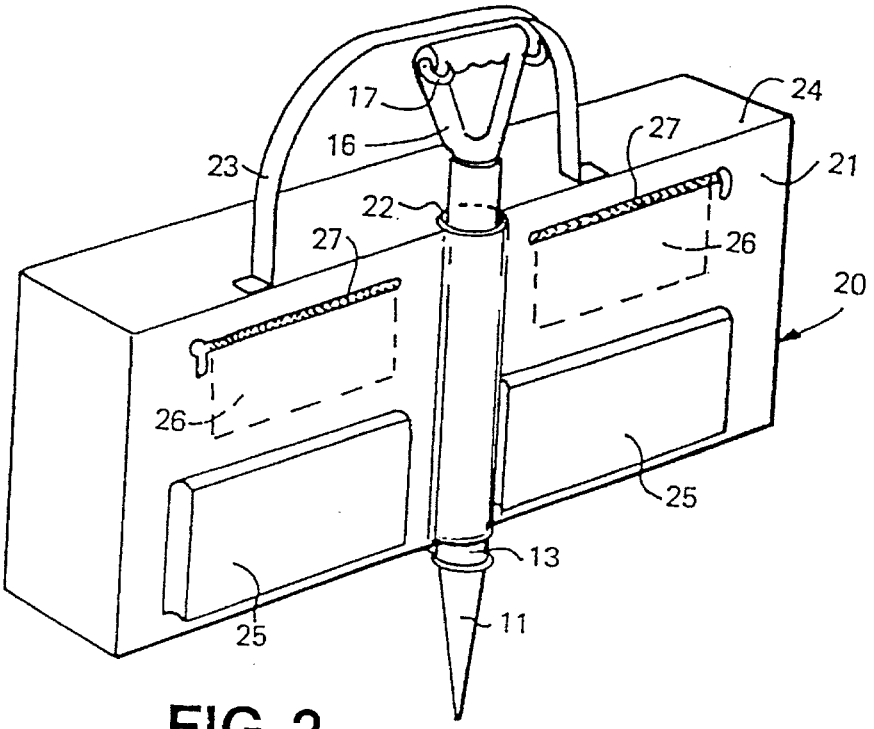
FIG. 2 is an isometric view showing one side of the organiser.

Referring now to FIG. 2 there is shown a bag generally indicated at (20), of generally rectilinear form and containing adjacent one wall (21) thereof an upright tubular sleeve (22) through which may pass the spike (11) and stem (13). A handle (23) attached to the top (24) of the bag (20) is then permitted to rest upon the supporting hooks (17) so that the bag is suspended in that position in relation to the ground engaging stand (10), thus to be held clear of the ground. The hooks (17) are shown in FIG. 1*b* in a locked position to prevent premature or unauthorised removal of the bag. Since the stem (13) is rotatably located in socket (12), the bag can be rotated freely about the upright axis of the stand to provide access to all sides.

The bag (20) may be formed from a woven or perforated material preferably of a lightweight and washable nature and may contain an internal framework if required to hold the bag in a substantially erect form as illustrated in FIG. 2. The bag may consist of a single compartment with a single opening or may have several separate compartments such as are illustrated at (25) in the form of open pockets, and at (26) in the form of as enclosed pockets (26) with sliding clasp fasteners (27).

Figure 3:
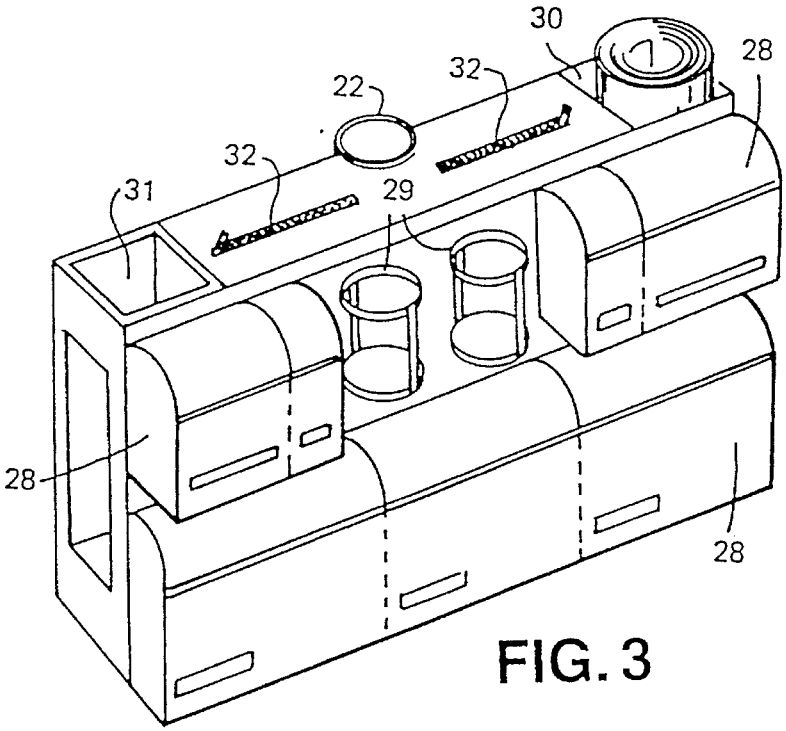
FIG. 3 is an isometric view showing an opposite side of the organiser.

Referring now to FIG. 3 on the opposite side of the bag there may be provided several pockets (28) providing a number of separate external compartments. All of the external pockets are preferably constructed from a soft and collapsible material so that the whole device may be stored flat when not in use and may have opening flaps fastened by, for example, press studs or touch-and-close fastener. Also on one or more sides of the bag as shown in FIG. 3 there may be attached holders (29) to receive cups or drinks cans. These holders are preferably fabricated and attached in such a way that they may be folded flat when not in use.

In the main body of the bag and accessible from the top (24) thereof there can be an upright compartment such as illustrated at (30) to receive a newspaper or magazine and at the opposite end of the bag there is shown a receptacle (31) into which can be placed a disposable plastics bag to receive waste materials for disposal.

In the top of the bag between compartments (30) and (31) two further internal compartments may be provided and accessible by means of sliding clasp fasteners (32) such that cameras, jewelry and other valuable items may be stored.

Typically when used on the beach the pouches or compartments (28) may be used to store protective sun creams, cosmetics and other such personal effects.

If the bag (20) is held in the erect position as illustrated in FIGS. 2 and 3 by means of an internal framework, it is preferably that such framework will be collapsible so that the entire bag may be stored flat for travelling and stowage.

Figure 4:
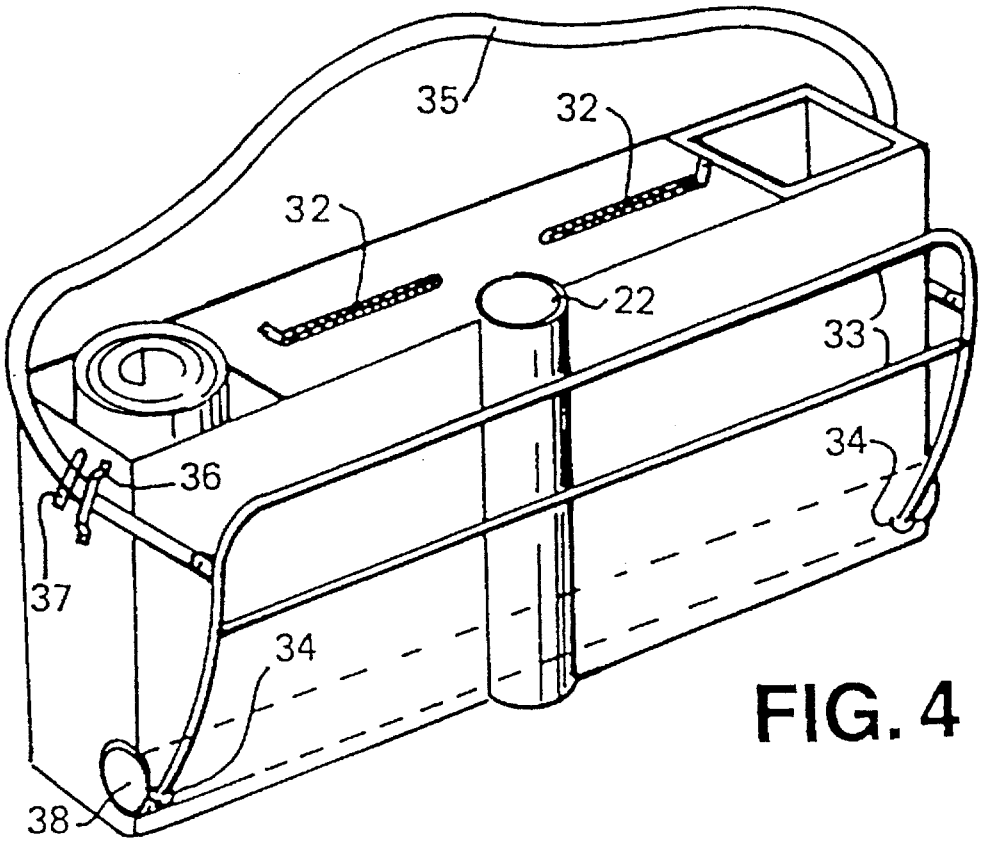
FIG. 4 is a view of an organiser similar to that shown in FIG. 2 but illustrating additional or alternative features.

Referring now to FIG. 4, there is provided on one side wall of the bag and preferably the side wall (21) as illustrated in FIG. 2, a hanging rail or rails (33) pivotally attached near the bottom of the side wall at (34) and having attached to each end thereof in an upper region a shoulder strap (35) by which the bag may be carried and which passes through a pair of loops (36) fixed to the end walls of the bag near the upper end. Stop members (37) are attached to the strap (35) to arrest the pivotal opening movement of rails (33) at the position illustrated in FIG. 4. In this way, when the device is mounted on the ground engaging stand a towel or clothing may be hung over the rails (33) in order to keep them off the ground, perhaps for drying.

For further convenience, a tubular sleeve (38) extends from end-to-end of the bag near its lowermost extremity, to house, if required, the stem (13) and spike (11) during transit. The handle (16) and spindle (15) may remain located on the stand so long as some retention means is provided to prevent the spindle (15) from falling out of the socket (14) but still permitting relative rotation therein.

Figure 5:
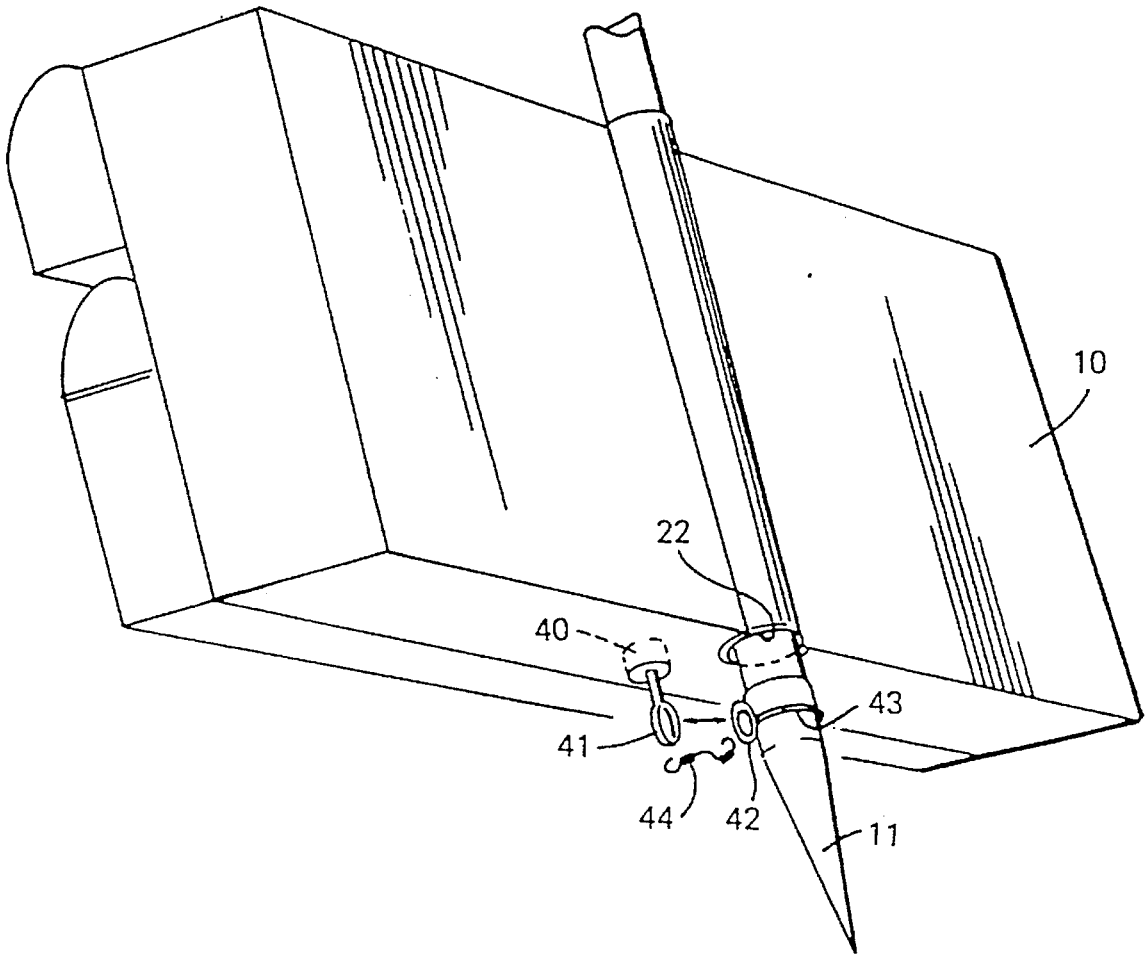
FIG. 5 is an underside view.

Referring now to FIG. 5, there is illustrated an alarm device (40) located in the base of the bag with a loop (41) exposed beneath the latter. A similar loop (42) is provided on a loose rotatable ring (43) located on the spike (11). By attachment of a cord (44) between the loops (41) and (42), security is ensured such that should the bag become separated from the spike, tension in the cord (44) will pull downwards upon the loop (41) and activate alarm (40). The latter can be arranged to emit an audible alarm or a visual indication such as brightly coloured smoke. With this arrangement, a user may feel confident to leave the bag unattended on the beach. The ring (43) is rotatable on spike (40) so that when the bag (10) and spindle (13) are rotated relative thereto the cord (44) is not placed under tension.

It will be appreciated that since towels may be suspended over rails (33) outside of the bag whether the device is in use or in transit, the overall size of the bag may be considerably reduced in relation to holdalls conventionally used for this purpose, whose excessive size is normally determined by the need to contain several bulky towels. The compartmental nature of the organiser enables the convenient stowage of many different items which are nevertheless readily accessible in their separate compartments. Hence, individual items are instantly recognised and retrieved.

It is not intended to limit the invention to the above example only, many variations of the individual features being possible without departing from the scope of the invention. For example, the stand (10) need not necessarily be in three separate parts and could be in the form of a single pole having a tapered lower end with some means to permit rotation of the bag when suspended therefrom. The fronts of pockets (28) may be provided with labels to enable a user to specify the contents, and the sliding clasp fasteners (27) and (32) may have locks to prevent unauthorised access.

The stand (10) may be partially or wholly attached to the bag (20) being a permanent fixture thereto, and in this case, for convenience, the spike (11) is preferably detachable and capable of being stowed in a sleeve such as that illustrated at (38) in FIG. 4. If the stand is permanently attached to the bag the handle (16) may optionally be fixed or removable but preferably the bag should still be provided with means to enable it swivel or rotate about the vertical axis of the stand. In this way both sides of the bag may be readily accessible to two or more persons with the organiser situated between them.

The device may be provided in a selection of different sizes with different numbers of compartments according to the required use. Further accessories may be removably attachable to the bag either by press studs or touch-and-close fastener provided where required on the external walls thereof.

In another form of the device, the bag may be adapted to receive in the sleeve (22) the pole of a parasol stand, provided that the pole has some means for supporting the bag above the ground, for example by way of the handle (23) engaging upon horizontal members protruding from the parasol stand.

For increased balance the sleeve (22) or other means for location of the stand, may be disposed on the centre of gravity of the bag.

I claim:

1. An organiser for personal effects, comprising a bag having at least one compartment, at least one opening for access thereto, and means on the bag engageable with a ground engaging member such that the entire bag may be supported thereon at an elevated position above the ground, characterised by an alarm device adapted for connection to the ground engaging member in use such that the alarm device is activated upon an attempt to remove the bag from the ground engaging member.

2. An organiser as claimed in claim 1 including at least one hanging rail attached to the bag whereby a towel or the like may be suspended at said elevated position above the ground.

3. An organiser according to claim 2, wherein the hanging rail is movably attached to the bag thus to be folded against the latter for storage and transportation.

4. An organiser according to claim 1 including means enabling the bag to be rotated through 360° about an upright axis defined by the ground engaging member.

5. An organiser according to claim 1 including a ground engaging member consisting of a spike, an elongate stem and a carrying handle, said engageable means on the bag comprising an upright tubular sleeve through which the stem of the ground engaging member may pass, and hook means on said handle for engaging said bag for suspension thereon.

6. An organiser according to claim 5, wherein of the ground engaging member, said spike and said handle are detectable from said stem and wherein means are provided for attachment of the handle directly to said spike for driving same into and removing same from the ground.

7. An organiser according to claim 1, wherein said bag has several,compartments at least some of which have closure means and at least one of which consists of an external pocket.

8. An organiser according to claim 1, wherein the material of said bag is collapsible for storage.

9. An organiser according to claim 1, including means on said bag for receiving said ground engaging member in a non-upright position, for transportation.

10. An organiser according to claim 1, wherein the bag and at least a part of the ground engaging member are permanently attached one to the other.

11. An organiser according to claim 1, wherein said bag includes an internal framework to hold the bag in a substantially erect form.

12. An organiser according to claim 4 wherein said hook means are lockable to prevent premature or unauthorised removal of the bag from the ground engaging member.

* * * * *